United States Patent [19]

Seremjian

[11] Patent Number: 4,630,454

[45] Date of Patent: Dec. 23, 1986

[54] DEVICE FOR HOLDING INTERIM CROCHET STITCHES AGAINST UNRAVELLING

[76] Inventor: Carmella M. Seremjian, 10721 Greenbay Rd., Kenosha, Wis. 53142

[21] Appl. No.: 783,668

[22] Filed: Oct. 3, 1985

[51] Int. Cl.[4] ..... D04B 35/00

[52] U.S. Cl. ..... 66/1 A; 66/118

[58] Field of Search ..... 66/1 A, 1 R, 116, 117, 66/118; 206/380, 206, 38, 234

[56] References Cited

U.S. PATENT DOCUMENTS

| | | | |
|---|---|---|---|
| 1,131,621 | 3/1913 | White | 66/118 |
| 1,496,579 | 6/1924 | Kraus | 66/118 |
| 2,446,155 | 7/1948 | Karle | 220/375 |
| 2,544,429 | 3/1951 | Kadisch et al. | 66/117 |
| 2,608,076 | 8/1952 | Owens | 66/118 |
| 2,852,054 | 9/1958 | Motley | 220/339 |
| 2,958,439 | 11/1960 | Yochem | 220/375 |
| 3,860,135 | 1/1975 | Yung et al. | 220/375 |
| 3,970,195 | 7/1976 | Franklin | 206/380 |
| 4,036,357 | 7/1977 | Czlen | 220/375 |
| 4,049,165 | 9/1977 | Goldhaft | 206/38 |
| 4,112,711 | 9/1978 | Tripp | 66/1 A |
| 4,339,056 | 7/1982 | Berkstresser | 220/375 |

FOREIGN PATENT DOCUMENTS

| | | | |
|---|---|---|---|
| 1350572 | 4/1974 | United Kingdom | 66/1 A |

*Primary Examiner*—Ronald Feldbaum

*Attorney, Agent, or Firm*—Hill, Van Santen, Steadman & Simpson

[57] ABSTRACT

A device and method for temporarily holding an interim crochet stitch against unravelling when a crochet hook is removed from the loop of the stitch. The flexible element may be an extension from a crochet hook, or it may be an extension from a crochet hook container, or it may comprise a closure flap for tubular or barrel container.

14 Claims, 6 Drawing Figures

DEVICE FOR HOLDING INTERIM CROCHET STITCHES AGAINST UNRAVELLING

BACKGROUND OF THE INVENTION

This invention is concerned with the knitting art, and more particularly relates to a new and improved device especially adapted for holding interim crochet stitches against unravelling when a crochet hook is removed from the loop of the stitch.

As is well known in crocheting, each stitch is pulled by the crocheting hook through at least one preceeding stitch. As a result, if the thread or yarn, hereinafter to be referred to as "strand", is pulled upon before the last stitch has been anchored, unravelling will result. When a crocheting project is temporarily interrupted, therefore, care must be taken that the interim stitch (that is, the last stitch completed before the interruption but not to be the last stitch in the project) not be unravelled.

A conventional expedient for avoiding unravelling of the interim stitch is to leave the crocheting hook, or at least the manipulation shank of the hook, in the interim stitch which may be pulled tight against the hook by pulling on the strand. However, crochet hooks are desirably quite smooth and therefore liable to drop out of the interim stitch. Then, if the strand is pulled, unravelling occurs.

There is, therefore, a need for a convenient manner of holding an interim crochet stitch positively against unravelling when the crochet hook is removed from the loop of the stitch.

SUMMARY OF THE PRESENT INVENTION

An important object of the present invention to provide a new and improved device for temporarily holding an interim crochet stitch against unravelling when the crochet hook is removed from the loop of the stitch.

Another object of the invention is to provide such a device which are simple, efficient, and inexpensive.

In accordance with the principles of the present invention, there is provided a device for temporarily holding an interim crochet stitch against unravelling, when a crochet hook is removed from the loop of the stitch, and which comprises a flexible element for extending through the interim stitch loop, and means for releasably locking the element against unintentional displacement from the loop.

BRIEF DESCRIPTION OF THE DRAWINGS

Other objects, features and advantages of the invention will be readily apparent from the following description of a representative embodiment thereof, taken in conjunction with the accompanying drawing, although variations and modifications may be effected without departing from the spirit and scope of the novel concepts embodied in the disclosure, and in which.

DETAILED DESCRIPTION

Figure 1:
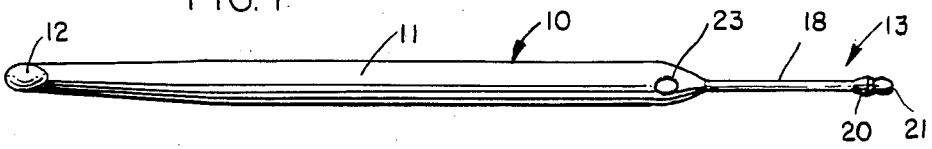
FIG. 1 is a plan view of a crochet hook embodying the present invention.
Figure 2:
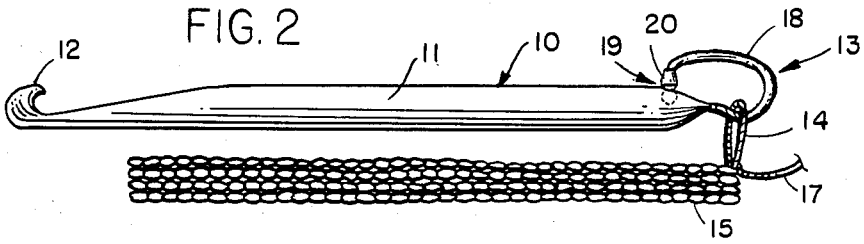
FIG. 2 is a side elevational view of the crochet hook showing how its stitch holding device functions.
Figure 3:
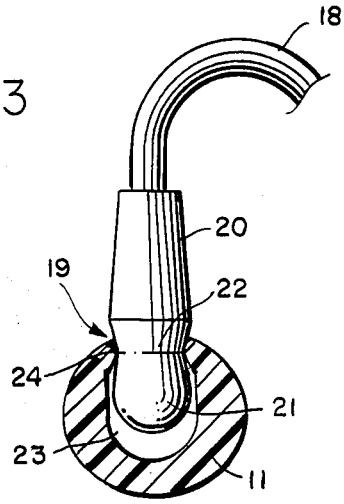
FIG. 3 is an enlarged fragmentary vertical sectional elevational detail view taken through the latching means for the stitch holding device shown in FIG. 2.

Referring to FIGS. 1 and 2, an elongated body comprising a crochet hook 10 has a shank 11 at one end of which is a hook 12.

At the opposite end of the crochet hook shank 11 is a device 13, supported by the shank, for holding an interim crochet stitch 14 against unravelling from a crocheted article 15 on which progress has been temporarily suspended. As will be observed, the crochet hook 10 has been removed from the stitch 14 and the device 13 functions to prevent unravelling of the stitch 14 upon relative pull between the article 15 in progress and a strand 17 which is being crocheted to produce the article 15.

In a desirable form, the device 13 comprises a flexible stitch retainer element for extending through the loop of the stitch 14. Where the crochet hook 10 is made from a self-sustaining plastic material such as polyethylene, polypropylene, polycarbonate, or the like, and wherein the formulation is such that in a relatively thin section there is adequate flexibility for the purpose, the device 13 comprises an elongated flexible element 18 which is a thin section extension substantially shorter than the shank 11 and having its proximal end attached to and projecting from the end of the shank 11 opposite to the hook 12, and may be integral with the shank. If preferred, the extension may be prefabricated and then attached to the shank 11.

At its distal end, the flexible element 18 has associated therewith means for releasably locking it against unintentional displacement from the loop of the stitch 14, through which the element has been extended substantially as shown in FIG. 2. In a desirable form, the releasable locking means comprises a releasable snap latch 19, wherein a digitally manipulatable latch pin 20 on the distal end of the flexible element 18 has a ball head latching terminal 21 connected to the pin by means of a reduced diameter neck groove 22. When the terminal 21 is pressed into a latching socket 23 in the shank 11, adjacent to the end carrying the device 13, detent means in the form of a lip structure 24 at the entrance into the socket 23 will engage latchingly in the neck groove 22. Resilience of the material of the shank 11 and/or the head 21 is relied upon to yieldably pass the latch head 21 in response to inserting or withdrawal force applied to the latch pin 20. To facilitate such action, the latch lip structure 24 is desirably smoothly rounded, and the socket 23 is desirably elongated in the direction of the length of the shank 11. This construction will lend itself to the snap-in and snap-out latching cooperating of the terminal 21 with the lip structure 24 even where the crochet hook 10 is made from metal and the latch pin 20 made from a suitable self-lubricating material such as polytetrafluoroethylene.

In for any reason the flexible element 18 cannot be made integrally with the shank 11, it may be formed separately and secured as by molded, welded or other means to the end of the shank. The principal considerations as to the flexible element 18 are that it be of a convenient length, and not too long or too short to be easily threaded through the stitch 14 and then flexibly manipulated into position for securing the releasable latch 19 whenever desired.

Figure 4:
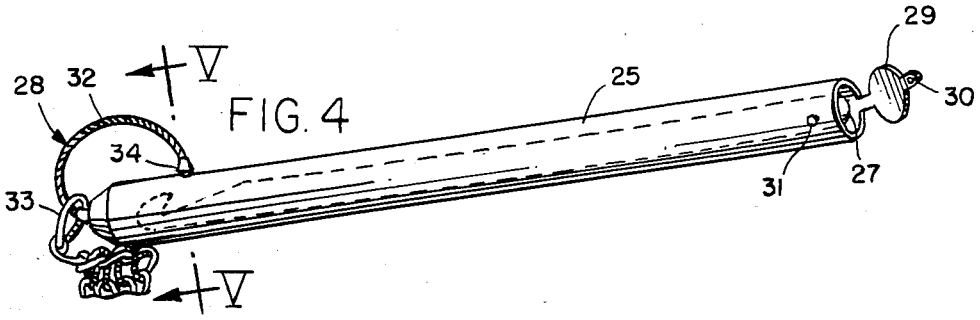
FIG. 4 discloses a crochet hook barrel container embodying the invention.
Figure 5:
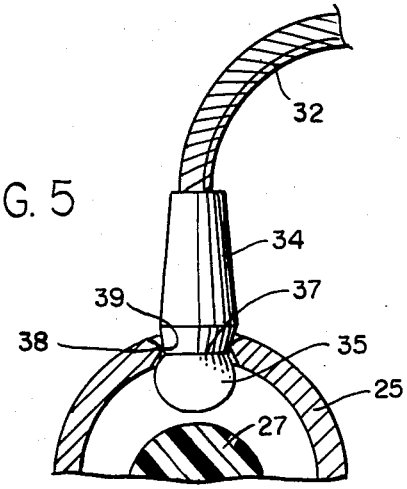
FIG. 5 is an enlarged fragmentary sectional elevational detail view taken substantially along the line V—V in FIG. 4.

In another arrangement, as shown in FIGS. 4 and 5, where it may not be practical to equip the crochet hook itself with the stitch holding device, a tubular scabbard or barrel container 25 for a crochet hook 27 may be equipped at its closed end with a stitch holding device 28. At its opposite open end, the container 25 is equipped with a closure flap 29 which may have a releasable snap 30 cooperating with a complementary snap part 31 on the body of the container.

In a desirable construction, the holding device 28 comprises a flexible element 32 substantially shorter than the body of the scabbard 25 and firmly secured to and providing an extension from the closed end of the scabbard 25. The flexible element 32 is adapted to be inserted through the loop of a stitch 33 and then releasably latched to the scabbard 25. For this purpose the element 32 is desirably provided with latch means comprising a distal end latch pin 34 having a latching terminal tip 35 extending from an annular latch groove 37 within which latch detent lip structure 38 about a latch opening 39 in the adjacent end portion of the casing of the container 25 is adapted to engage releasably when the latch tip 35 is thrust into the socket provided by the hole 39. It will be observed in FIG. 5 that the latch pin 34 is of a length to facilitate digital manipulation of the device.

Figure 6:
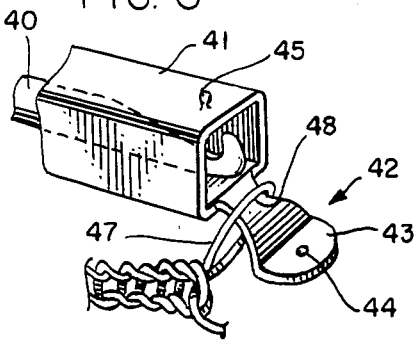
FIG. 6 is a fragmental elevational view of another type of crochet hook barrel container embodying the invention.

In another arrangement as shown in FIG. 6 for accommodating a situation where a crochet hook 40 may not feasibly be equipped with a stitch holding device, a tubular hook receiving container 41 as provided for the crochet hook, and a combination container closure and crochet stitch holding device 42 may be provided as shown in FIG. 6. In this instance, the device 42 comprises a flexible closure flap element 43 which is substantially shorter than the length of the body of the container 41 and is attached at the proximal end of the flap element to the open end of the container 41. At its distal end portion, the flap 43 is provided with releasable retaining snap means 44 engagable with cooperative snap means 45 on the adjacent end portion of the container 41 for releasably retaining the flap 43 in the container closing and stitch holding condition when desired.

For its stitching holding function, the flap 43 is desirable flexible and of a width and length to facilitate projecting the flap through the loop 47 after which the flap 43 is deflected into latching position wherein the latch 44, 45 is closed to retain the flap 43 in its container closing and loop holding position. For facilitating engaging and holding the crochet stitch 47, the flap 43 is desirably provided with a reduced width neck 48.

It will be understood that variations and modifications may be effected without departing from the spirit and scope of the novel concepts of the present invention.

I claim as my invention:

1. A device for temporarily holding an interim crochet stitch against unravelling when a crochet hook is removed from the loop of the stitch, comprising:

an elongated body having opposite ends;

a flexible stitch retainer substantially shorter than said body and having a proximal end and a distal end;

said proximal end of said retainer fixedly attached to one end of said body;

said retainer being freely extensible from said one end of said body for extending the retainer through said stitch for holding the stitch against unravelling;

latching means on said distal end of said retainer;

complementary latching means on said body adjacent to said one end;

and said latching means being operable by manipulation of said retainer for latching cooperation for holding said distal end latched to said body for maintaining said retainer in the stitch retaining relation to said one end of the body and said latching means being releasable by manipulation of said retainer for releasing said retainer distal end relative to said body for releasing said stitch from said retainer.

2. A device according to claim 1, wherein said body comprises the crochet hook itself.

3. A device according to claim 2, wherein said flexible retainer comprises an axial extension from said one end of said crochet hook.

4. A device according to claim 1, wherein said body comprises a tubular crochet hook container.

5. A device according to claim 4, wherein said container has an open end and a closed end, and said one end is said closed end.

6. A device according to claim 1, wherein said flexible retainer comprises a closure flap on a tubular crochet hook container.

7. A device according to claim 1, wherein said latching means on said distal end of said retainer comprises a terminal pin having a head and said latching means on said body comprises a socket receptive of said head by snap-in manipulation of said pin, and said head being releasable from said socket by snap-out manipulation of said pin.

8. A device according to claim 7, wherein said body is metal and said head is a resilient plastic material.

9. A device according to claim 1, wherein said body is the shank of said crochet hook, said latching means on the body being a socket in said shank and said latching means on said retainer being a latching head engagable in retaining relation in said socket.

10. A device according to claim 1, wherein said body comprises an elongated crochet hook tube, said latching means on said retainer comprising a snap-in latching head, and said latching means on said body comprising a socket in said tube and into which socket said head is releasably engagable.

11. A device according to claim 1, wherein said body comprises a crochet hook retaining container tube, and wherein said one end is open for receiving the crochet hook into the tube, said retainer comprising a closure flap on said one end for said opening, said closure flap having a reduced neck for receiving said loop, said latching means on said body comprising a releasable snap part on said tube, and said latch means on said retainer comprising complementary snap means for cooperation with said part for retaining said flap in loop-retaining and open end closing relation to the tube.

12. A device according to claim 1, wherein said body comprises the crochet hook having an elongated shank, said shank being formed from plastic, and said retainer comprising a thin, integral extension from the end of the shank opposite the end of the shank carrying the crochet hook.

13. A device according to claim 9, wherein said shank of the crochet hook is formed from plastic, said socket having an entrance with resilient lips, and said latching head having a groove within which the lips are engagable when the head is in retaining relation in said socket.

14. A device according to claim 1, wherein said latching means on the distal end of said retainer comprises a manipulatable pin having a head, and said complementary latching means on said body comprising a socket within which said head is releasably retainingly engagable.

* * * * *